US005599214A

United States Patent [19]

Sakai et al.

[11] Patent Number: 5,599,214

[45] Date of Patent: Feb. 4, 1997

[54] TERMINAL CHAIN AND TERMINAL LUG

[75] Inventors: Hitoshi Sakai; Toshinori Yamamoto, both of Haibara, Japan

[73] Assignee: Yazaki Corporation, Tokyo, Japan

[21] Appl. No.: 385,674

[22] Filed: Feb. 8, 1995

[30] Foreign Application Priority Data

Feb. 10, 1994 [JP] Japan ..... 6-16122

[51] Int. Cl.[6] ..... H01R 4/18

[52] U.S. Cl. ..... 439/877; 439/867

[58] Field of Search ..... 493/865, 867, 493/877, 885, 748

[56] References Cited

U.S. PATENT DOCUMENTS

| | | | |
|---|---|---|---|
| 2,778,097 | 1/1957 | Berg | 439/885 X |
| 3,242,458 | 3/1966 | Raymond et al. | 439/867 |
| 3,286,221 | 11/1966 | Blakesley | 439/867 X |
| 3,663,931 | 5/1972 | Brown | 439/885 X |
| 4,781,628 | 11/1988 | Detter et al. | 439/748 |
| 4,957,451 | 9/1990 | Nadin | 439/885 X |
| 5,302,146 | 4/1994 | Yamamoto | 439/877 |
| 5,489,222 | 2/1996 | Moyer et al. | 439/748 |

*Primary Examiner*—Allan N. Shoap
*Assistant Examiner*—Christopher J. McDonald
*Attorney, Agent, or Firm*—Armstrong, Westerman, Hattori, McLeland, & Naughton

[57] ABSTRACT

A structure is provided whereby an insertion hole in a waterproof stopper is prevented from damage upon pulling a terminal out of an electric connector of a waterproof type. A terminal lug includes an electric contact section, a wire connection section and a joining portion through which the lug is joined to a terminal carrier. In the condition where the wire connection section is crimped on a wire, the cut joining portion is offset to a position closer to the central axis of the lug than the bottom plate portion of the wire connection section so that both ends in a width direction of the cut lug are located inside a contour formed by, and axially extended from, the wire connection section.

4 Claims, 4 Drawing Sheets

TERMINAL CHAIN AND TERMINAL LUG

BACKGROUND OF THE INVENTION

1. Field of the Invention

This invention relates to a terminal lug for use with an electric connector used in connection with an automotive wiring harness, and the like, and more particularly, to a terminal lug for use with a waterproof type electric connector.

2. Description of the Related Art

FIG. 11 shows conventional terminal lugs. In this figure, a terminal lug a comprises a female electric contact section a1 and a wire connection section a2. The terminal lugs are each integrally joined via a joining portion c to one side of a strip-like terminal carrier b and carried to a known press connection machine (not shown).

The terminal lugs a are successively cut at the joining portions c and separated from the terminal carrier b in the press connection step while, at the same time, conductor holding pieces a2' and cover holding pieces a2" of the terminal lugs a are respectively crimped on conductors d1 and covers d2 of wires d so as to attach the terminal lugs to ends of the wires d (FIG. 13).

In this instance, since the joining portion c is of a flat plate shape that lies in the same plane as the strip-like flat terminal carrier b (FIG. 12), edge portions c1, c1 at both ends in a transverse direction of the cut joining portion c are caused to protrude outside an outer periphery of the crimped cover-holding piece a2" of the wire connection section a2 (FIG. 14).

FIG. 15 shows an electric connector of a waterproof type, in which in an open area f at the rear end of a connector housing e is fitted with a rubber waterproof stopper g which is fixed in place by a stopper cover h of synthetic resin. In the waterproof stopper g insertion holes j are formed each corresponding to a respective terminal accommodating chamber i formed in the connector housing e, and in the stopper cover h throughholes k are formed corresponding to the insertion holes j. A terminal lug a attached to the wire d is inserted from the throughhole k through the insertion hole j into the terminal accommodating chamber i and locked therein by a resilient locking piece l.

When replacement is in order, the terminal lug a is disengaged from the resilient locking piece l with a jig and pulled at the wire d to remove the terminal lug. In this instance, the aforesaid protruding edge portions c1 of the joining portion c damages the insertion hole j in the waterproof stopper g, thereby lowering the waterproof performance of the waterproof stopper.

SUMMARY OF THE INVENTION

This invention has been accomplished to overcome the above drawback and gives a structure in which, in the terminal lug connected with a wire, the joining portion at the rear end of the terminal lug does not protrude outside the crimped wire connection section of the terminal lug.

To achieve the above object, according to an aspect of this invention there is provided a chain of terminals which comprises: a terminal carrier; and a plurality of terminal lugs joined in a row to the terminal carrier, each via a respective joining portion, to form a terminal chain, each of the terminal lugs including a wire connection section comprising a bottom plate portion and wire holding means adapted to cooperate with the bottom plate portion to fix a wire therebetween, wherein each of the joining portions is located at a position closer to the central axis of a respective one of the terminal lugs than the related bottom plate portion so that opposite ends in a width direction of each of the joining portions are located inside a contour formed by, and axially extended from, the related wire holding means.

According to another aspect of this invention, there is provided a chain of terminals comprising: a terminal carrier; and a plurality of terminal lugs joined in a row to the terminal carrier, each via a respective joining portion, to form a terminal chain, each of the terminal lugs including a wire connection section comprising a bottom plate portion and wire holding means adapted to cooperate with the bottom plate portion to fix a wire therebetween, wherein each of the joining portions has a curved cross section substantially identical with the curved cross section of the related one of the bottom plate portions.

According to a further aspect of this invention, there is provided a terminal lug comprising: a wire connection section including a bottom plate portion and wire holding means adapted to be crimped on a wire on the bottom plate portion to connect the wire to the terminal lug, the wire holding means comprising a wire cover holding means and a wire conductor holding means, wherein when the wire holding means is crimped on the wire, a cut joining portion continuous with respect to the bottom plate portion of the wire connection section is located at a position closer to the central axis of the terminal lug than the bottom plate portion so that opposite ends in a width direction of the joining portion are located inside a contour formed by, and axially extended from, the crimped wire cover holding means.

According to a yet further aspect of this invention, there is provided a terminal lug comprising: a wire connection section including a bottom plate portion and wire holding means adapted to be crimped on a wire on the bottom plate portion to connect the wire to the terminal lug, wherein, when the wire holding means is crimped on the wire, a cut joining portion continuous with respect to the bottom plate portion of the wire connection section has a curved cross section substantially identical to a curved cross section of the bottom plate portion.

According to this invention, since the edge portions at both lateral ends of a cut joining portion do not protrude outside the holding means crimped on a wire, the edge portions of the joining portion do not damage the insertion hole of the waterproof stopper upon pulling the terminal lug out of the connector housing.

The above and other objects, features and advantages of this invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
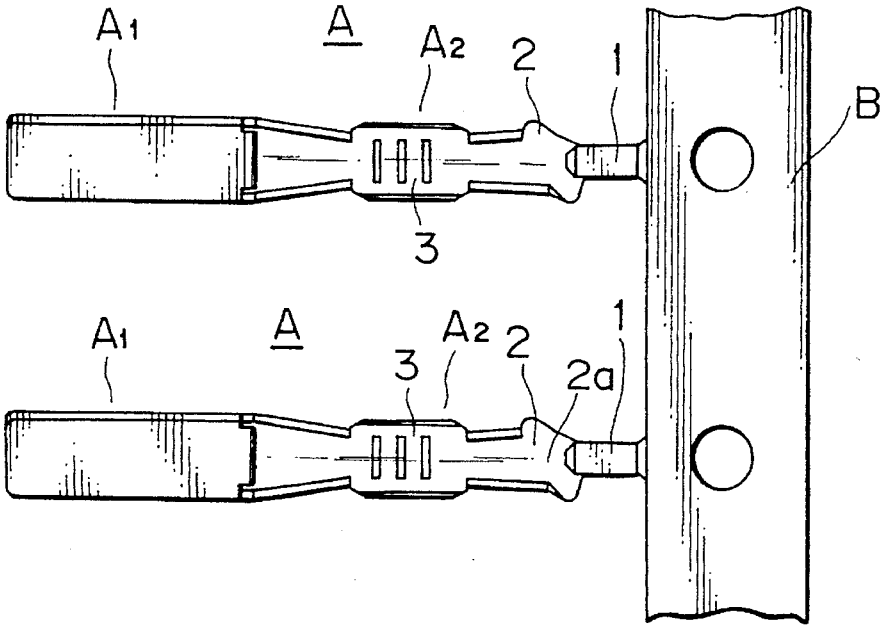
FIG. 1 is a plan view of a terminal chain showing a preferred embodiment of this invention.
Figure 2:
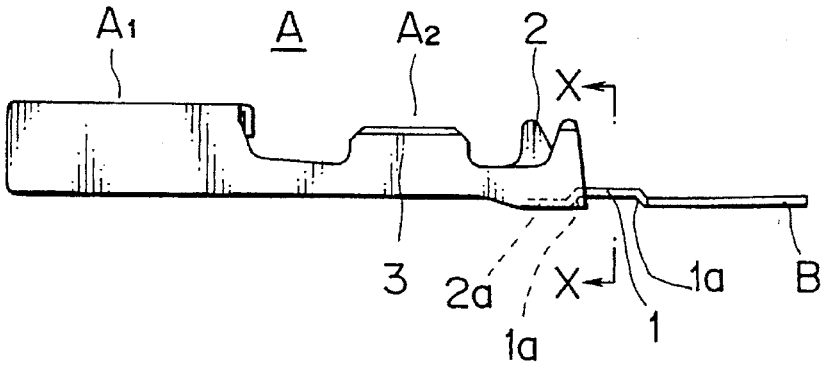
FIG. 2 is a side view of the terminal chain shown in FIG. 1.
Figure 4:
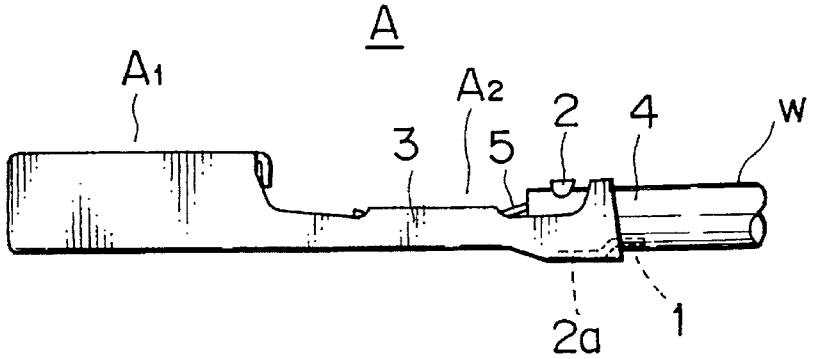
FIG. 4 is a side view of a terminal lug separated from a terminal chain and attached to a wire.

Referring to FIGS. 1 and 2, there is shown a terminal chain to which this invention is applied. A plurality of terminal lugs A are joined in a row, each via a respective joining portion 1, to one side of a strip-like terminal carrier B which carries the terminal lugs to a press connection machine (not shown). Each terminal lug A comprises a female electric contact section A1 and a wire connection section A2. The wire connection section A2 comprises a bottom plate portion 2*a* and two spaced pairs of wire holding pieces 2, 3 formed integrally with the bottom plate portion 2*a*. The pair of holding pieces 2 are for holding the cover of a wire and the other for holding the conductor of the wire (FIG. 4).

Figure 3:
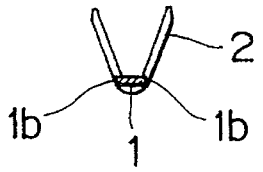
FIG. 3 is a sectional view taken along line X—X in FIG. 2.

The joining portion 1 has raised portions 1*a*, 1*a* at opposite ends in the joining direction by means of which the joining portion 1 is stepped to a position closer to a center axis of the terminal lug than the bottom plate portion 2*a* of the wire connection section A2 and the flat terminal carrier B. As a result, as shown in FIG. 3 opposite ends 1*b*, 1*b* in a width direction of the joining portion 1 substantially coincide with; i.e. do not extend outwardly from, an outer periphery of the wire cover holding pieces 2 that diverge.

Figure 5:
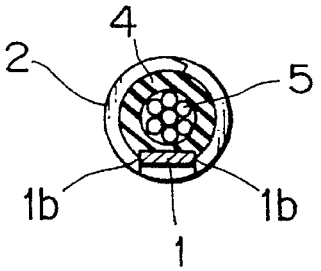
FIG. 5 is a rear end view of the terminal lug shown in FIG. 4.

A terminal lug A fed to the press connection machine is cut at an intermediate portion of the joining portion 1 and separated from the terminal carrier B, and the wire cover holding pieces 2 and the wire conductor holding pieces 3 are respectively crimped on the cover 4 and the conductor 5 of the wire W so that the terminal lug is connected to the wire W. In the condition in which the terminal lug A is connected to the wire W, both ends 1*b*, 1*b* in a width direction of the cut joining portion 1 do not protrude outside a contour formed by and axially extended from an outer periphery of the wire cover holding pieces 2, as shown in FIG. 5.

Figure 6:
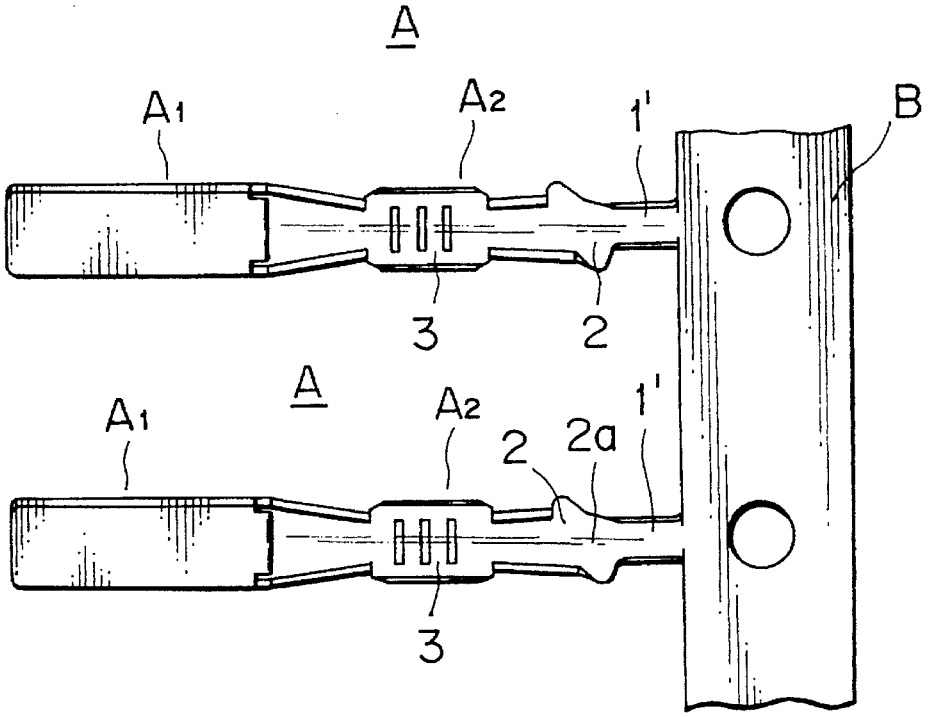
FIG. 6 is a plan view of a terminal chain showing another preferred embodiment of this invention.
Figure 7:
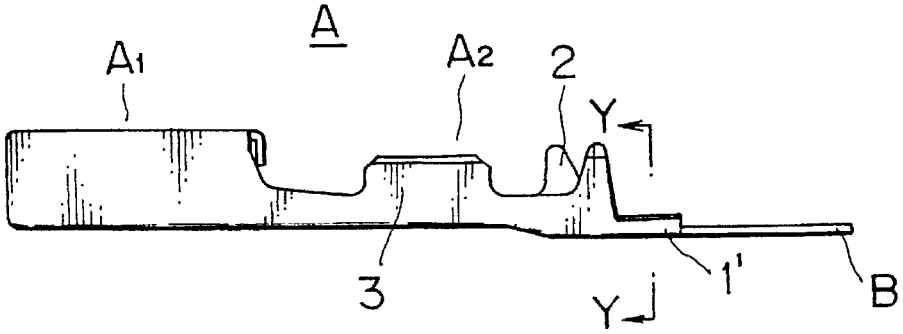
FIG. 7 is a side view of the terminal chain shown in FIG. 6.

Referring to FIGS. 6 and 7, there is shown a terminal chain according to another embodiment of this invention. According to this embodiment the joint portion 1' is curved upwardly in cross section in correspondence with the bottom plate portion 2*a* of the wire connection section A2.

Figure 8:
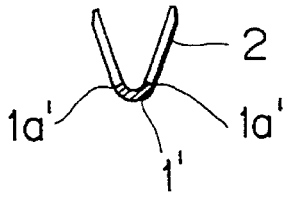
FIG. 8 is a sectional view taken along line Y—Y in FIG. 7.
Figure 10:
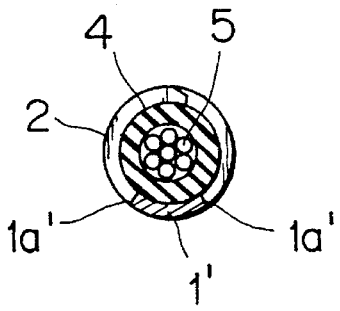
FIG. 10 is a rear end view of the terminal lug shown in FIG. 9.
Figure 9:
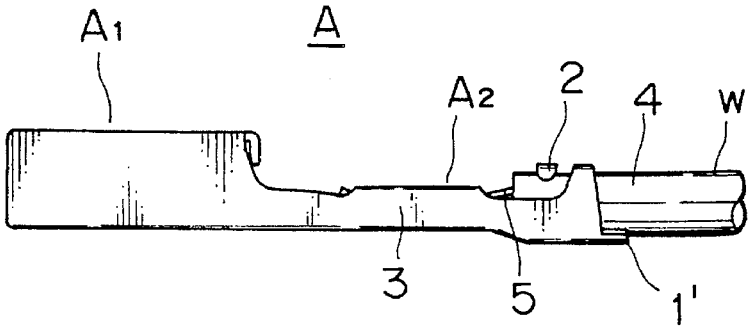
FIG. 9 is a side view of a terminal lug of FIG. 7 separated from a terminal chain and attached to a wire.
Figure 11:
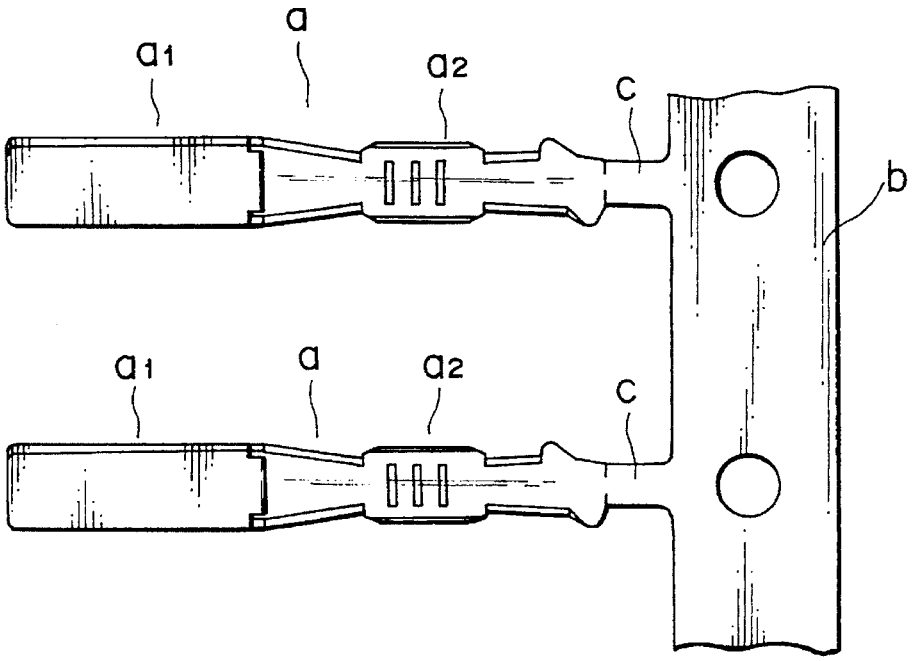
FIG. 11 PRIOR ART
FIG. 11 is a plan view of a conventional terminal chain.
Figure 12:
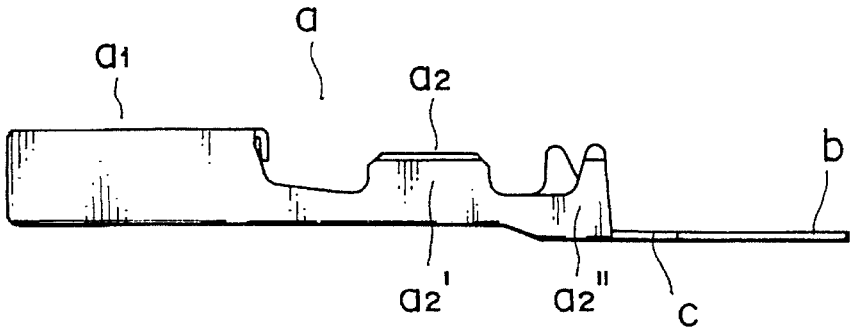
FIG. 12 PRIOR ART
FIG. 12 is a side view of the terminal chain shown in FIG. 11.
Figure 13:
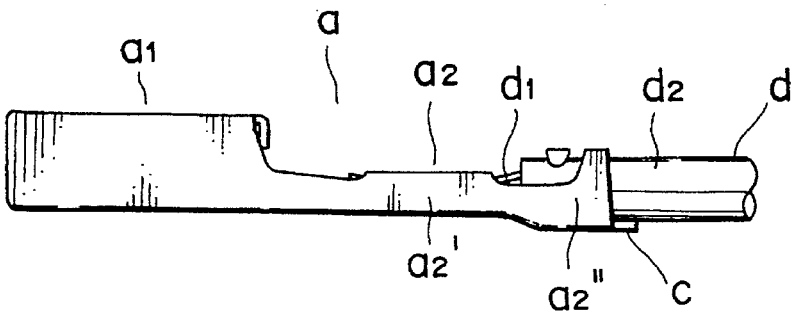
FIG. 13 PRIOR ART
FIG. 13 is a side view of a terminal lug of FIG. 11 separated from a terminal chain and attached to a wire.
Figure 15:
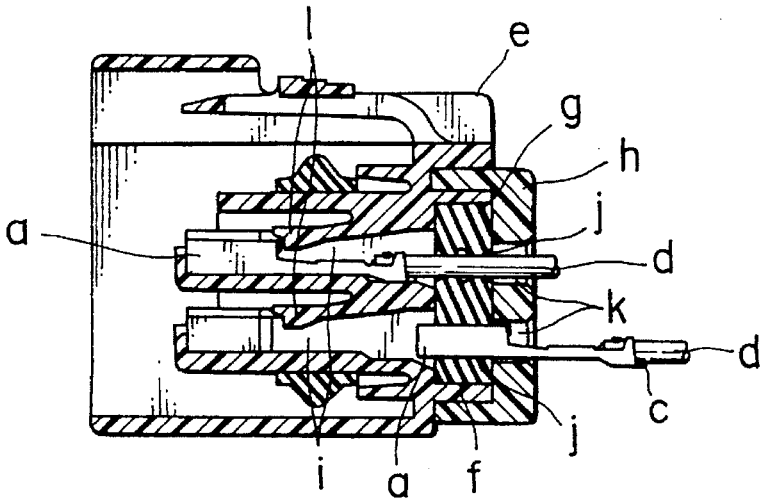
FIG. 15 PRIOR ART
FIG. 15 is a sectional view of a connector of waterproof type.
Figure 14:
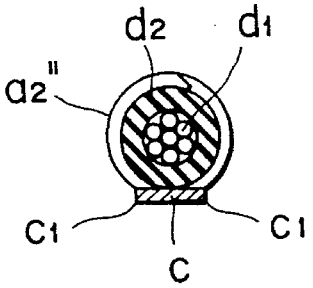
FIG. 14 PRIOR ART
FIG. 14 is a rear end view of the terminal lug shown in FIG. 13.

As a result, the edge portions 1*a*', 1*a*' at both ends in a width direction of the curved joining portion 1' are, both before and after connection of the terminal lug to a wire, located within a contour formed by, and axially extended from, the wire cover holding pieces 2 (FIG. 8 and FIG. 10).

As mentioned above, according to this invention, since the edge portions at lateral sides of a joining portion cut and slightly extended from the rear end of the terminal lug are, in the condition where the terminal lug and a wire are connected, located inside a contour formed by, and axially extended from, the wire cover holding pieces of the terminal lug, no damage will be caused by these edge portions to the insertion hole in the waterproof stopper upon pulling the terminal lug out of the connector housing, thus preventing the possibility of reducing the sealing performance of the stopper.

What is claimed is:

1. A chain of terminals comprising:

a terminal carrier; and a plurality of terminal lugs joined in a row to said terminal carrier, each via a respective joining portion, to form a terminal chain, each of said terminal lugs including a wire connection section having a bottom plate portion and wire holding means formed integral with said bottom plate portion, adapted to cooperate with said bottom plate portion to hold and fix a wire therebetween, each of said joining portions adjacent said wire holding means containing a section which is raised away from said bottom plate portion so that opposite, laterally spaced ends of each of said joining portions are located inside a contour formed by, and axially extended from, said corresponding wire holding means.

2. A chain of terminals according to claim 1, wherein said wire holding means of each of said terminal lugs includes two longitudinally spaced holding means, both of said holding means being disposed on an opposite side of said terminal carrier with respect to said joining portion, one adjacent said terminal carrier for holding a cover of said wire, and the other for holding a conductor of said wire.

3. A chain of terminals according to claim 2, wherein each of said wire cover holding means and said wire conductor holding means includes a pair of holding pieces adapted to be crimped on one of said wire cover and said wire conductor of said the wire, respectively.

4. A terminal lug comprising:

a wire connection section including a bottom plate portion and wire holding means adapted to be crimped on a wire disposed on said bottom plate portion to connect said wire to said terminal lug, said wire holding means having a wire cover holding means and a wire conductor holding means, a joining portion extending from said bottom plate portion, said joining portion having laterally spaced ends and a section which is raised away from a plane of said plate portion to position said laterally spaced ends of said joining portion within a contour formed by said wire holding means When said wire holding means are crimped about said wire.

* * * * *